United States Patent [19]

Masterson et al.

[11] Patent Number: 4,657,586

[45] Date of Patent: Apr. 14, 1987

[54] SUBMERGED COMBUSTION IN MOLTEN MATERIALS

[75] Inventors: Ian F. Masterson, Danbury, Conn.; David B. George; Frederick A. Rudloff, both of Salt Lake City, Utah

[73] Assignee: Union Carbide Corporation, Danbury, Conn.

[21] Appl. No.: 791,514

[22] Filed: Oct. 25, 1985

[51] Int. Cl.[4] ..... C22B 15/00

[52] U.S. Cl. ..... 75/76; 75/59.19

[58] Field of Search ..... 75/59.19, 76, 82, 83

[56] References Cited

U.S. PATENT DOCUMENTS

| | | | |
|---|---|---|---|
| 3,258,330 | 6/1966 | Ito | 75/75 |
| 3,260,587 | 7/1966 | Dolf et al. | 65/135 |
| 3,619,177 | 11/1971 | Beck et al. | 75/76 |
| 3,844,768 | 10/1974 | Leroy | 75/59.19 |
| 3,932,172 | 1/1976 | Knuppel | 75/59.19 |
| 3,990,889 | 11/1976 | Queneau et al. | 75/74 |
| 3,990,890 | 11/1976 | Leroy | 75/76 |
| 4,023,781 | 5/1977 | Fassbinder | 75/59.19 |
| 4,545,800 | 10/1985 | Won et al. | 65/134 |

FOREIGN PATENT DOCUMENTS

| | | | |
|---|---|---|---|
| 998246 | 10/1976 | Canada | 53/300 |

*Primary Examiner*—Peter D. Rosenberg

*Attorney, Agent, or Firm*—Lawrence G. Kastriner; Stanley Ktorides

[57] ABSTRACT

A process for heating a molten material by injecting oxygen and a fuel into a molten bath of the material at a bath temperature above the spontaneous combustion temperature of the fuel, at least a portion of the fuel forming a shroud around the oxygen, and combusting the fuel to provide heat to the molten material. Where the molten material is impure copper the amount of oxygen and fuel injected may also be controlled to alternately oxidize and reduce the copper impurities and remove them from the bath. Solid material may be melted in the bath during any stage of heating or refining. In a preferred embodiment, a portion of the fuel forms a shroud around the oxygen during injection, and the oxygen forms a shroud around the remaining fuel.

53 Claims, 3 Drawing Figures

SUBMERGED COMBUSTION IN MOLTEN MATERIALS

BACKGROUND OF THE INVENTION

This invention relates to a process for heating and refining molten materials, and more specifically, to a process for heating and refining molten materials by subsurface injection of oxygen and a fluid fuel.

Molten metal refining processes known in the art have utilized subsurface injection of pure oxygen and a fluid hydrocarbon fuel. In some metal refining processes, the oxygen and hydrocarbon have been injected through a "shroud"-type tuyere. In these instances the oxygen is injected through a central tube and the hydrocarbon is injected through a surrounding annular tube, thereby forming a shroud around the oxygen. This shroud serves a protective function to prevent excessive erosion of the tuyere and surrounding refactory by the oxygen. The most widespread commercial use of this concept has been in Q-BOP steelmaking, described in U.S. Pat. No. 3,930,843. Applications in copper smelting have also been disclosed, for example, in U.S. Pat. Nos. 3,990,889 and 3,990,890.

While the hydrocarbon does play a part in the above process reactions, these processes are essentially oxidation refining operations. The amount of hydrocarbon injected is small in relation to the amount of oxygen injected (only up to about 8% in Q-BOP steelmaking) so as not to impede oxidation of the molten metal impurities. The low level of hydrocarbon protects the tuyere and refractory and, in doing so, results in the formation of frozen accretions. As used herein, the term "frozen accretions" refers to a formation of solid metal and/or slag in a molten metal bath near a tuyere which forms as the result of the cooling effect of an injected fluid. A frozen accretion is known variously in the art as a knurdle, a shanker, and a mushroom cap. As fluid injection proceeds, frozen accretions tend to increase in size until a thermal equilibrium is reached. Accretions can grow in size to cause blockage of a tuyere opening. For this reason, it has been heretofore thought that relatively high amounts of hydrocarbon could not be injected as a shroud around oxygen without encountering accretion problems.

Oxygen and hydrocarbons have also been utilized in refining copper, and, specifically, anode grade copper. Anode grade copper is refined from ore in a series of steps before it is ready for casting into anodes or other products. The initial steps of beneficiation, smelting and converting serve to concentrate and purify the ore to product crude or "blister" copper. The final refining step (known in the art as "fire refining") accomplishes the reduction of oxygen and sulfur impurities in the blister copper, typically from levels of 0.70% and 0.05%, respectively, to levels below 0.20% and 0.005%, respectively. Copper remelted from scrap may be fire refined also, either together with virgin material or by itself.

Fire refining is usually carried out in the temperature range of about 2000° F. (1090° C.) to 2200° F. (1200° C.) and in two steps. In the first step, an oxygen containing gas is injected beneath the surface of a bath of molten blister copper to oxidize sulfur to sulfur dioxide, which thereafter floats up and out of the bath. In the second step, known in the art as "poling", dissolved oxygen in the molten copper is removed by reduction with a hydrocarbon. The term "poling" comes from the traditional practice of immersing green wood poles in the molten bath to supply the fuels. More recent innovations in fire refining include the direct injection of mixtures of oxygen-containing gas and hydrocarbon fuels into the bath. The direct injection of these mixtures, generally by means of tuyeres located below the surface of the molten copper, has made it possible to control the fire refining process to a greater degree. This added control has not been without some degree of danger due to the presence of explosive mixtures of fluids in the piping.

The hydrocarbon fuels injected into the molten copper crack to produce carbon and hydrogen, which thereafter react with oxygen to form carbon monoxide, carbon dioxide, and water. These are emitted as off-gas from the molten copper bath. During the poling step, unreacted hydrocarbons may be emitted from the bath, as well as carbon soot formed from the incomplete combustion of the hydrocarbons.

Reduced opacity of emissions has become a major goal of commercial copper refiners. "Opacity", as used herein, refers to the capacity of the off-gas to obstruct the transmission of light, expressed as a percentage. No obstruction is expressed as 0%, while total obstruction is expressed as 100%. Volatile hydrocarbons, carbon soot, and other particulates emitted from molten copper baths during fire refining are major causes of emissions of high opacity from copper refining plants. Previous methods of fire refining copper have relied on post-treatment of the off-gases from the molten copper to meet opacity limits, now restricted to 20% or less in some cases. In the case of solid particulate matter, conventional baghouses are used to trap escaping matter. Volatiles on the other hand are removed by utilizing complex and costly afterburners, cooling towers and other systems to remove them from the off-gas.

Improved deoxidation efficiency has also become an important goal of commercial copper refiners. As used herein, "deoxidation efficiency" refers to the ratio, expressed as a percentage, of the actual amount of oxygen removed from the molten metal bath (impurity plus injected oxygen) per unit of fuel injected, to the theoretical amount of oxygen required to completely react with a unit of the fuel. While some high deoxidation efficiencies have been reported in relatively small-scale tests, the deoxidation efficiencies of commercial size reactors (1-150 tons and higher) have remained low. Improvement in this area brings the obvious benefit of lower fuel expenditures per unit of copper refined.

Conventional heating and refining processes have performed inefficiently due to low heat recovery. As used herein, "heat recovery" refers to the ratio, expressed as a percentage, of the sum of the amount of heat given off from the furnace to its environment plus the amount of heat absorbed during the process in raising the molten bath temperature, to the theoretical heat of combustion available from the injected fuel. In equation form, this is expressed as follows:

$$\%\text{ heat recovery} = \frac{(A \times B) + C}{D \times E} \times 100$$

Where

A = temperature rate increase of bath (°F./min) (°C./min)

B = heat capacity of bath (Btu/°F.) (cal/°C.)

C = heat loss of furnace (Btu/min) (cal/min)

D=fuel fuel flowrate ($ft^3$/min)($M^3$/min)

E=heat of combustion of fuel (Btu/$ft^3$) (cal/$m^3$)

This inefficiency has been especially apparent in the copper industry, where additional external heat input has been necessary to melt solid copper, usually prior to the refining step. Solid copper has also been added as a means of cooling down the bath when the bath temperature has exceeded the conventional fire refining range of 2000° F. (1090° C.) to 2200° F. (1200° C.). The recovery of available heat self-generated by the reaction of the impure molten copper and injected materials in prior fire refining processes has not been sufficient to overcome the cooling effect of solid copper additions to the bath at conventional fire refining temperatures.

The following patents disclose fire refining of impure molten copper by the injection of hydrocarbon fuels and oxygen-containing gas.

U.S. Pat. No. 3,258,330 discloses a process for fire refining blister copper wherein air containing oxygen in various densities is mixed with a solid or liquid hydrocarbon fuel and injected into a molten copper bath during the heating, oxidation and reduction stages of refining. The preferred ratios of oxygen to hydrocarbon, in terms of the theoretical amount necessary for combustion, are 80% to 130% during heating, 100 % to 200 % during oxidation, and 20% to 100% during reduction. The deoxidation efficiencies calculated from the patent disclosure range from about 30 to 40%.

U.S. Pat. No. 3,619,177 discloses a process for reducing the oxygen content of molten copper during fire-refining by introducing a mixture of a gaseous hydrocarbon and either air, oxygen-enriched air, or pure oxygen through a single tuyere below the bath surface in a quantity sufficient to form a reducing gas mixture within the melt. The calculated deoxidation efficiencies were 46 to 93% in small scale tests (up to 939 lbs. of molten copper), while in plant-scale testing (215 to 325 tons of molten copper), calculated deoxidation efficiency dropped to a range of 31 to 35%. The patent further discloses that pollutants emitted from the molten copper bath are minimized by blowing air and creating a reducing gas mixture over the bath.

Bearing in mind these and other deficiencies of the prior art, it is therefore an object of the present invention to provide a process for efficiently heating molten materials.

It is another object of the present invention to provide a process for refining impure copper which reduces air pollution.

It is another object of the present invention to provide a process for refining impure copper with increased deoxidation efficiency.

It is further object of the present invention to increase the heat recovery in a fire refining process.

It is another object of the present invention to utilize solid copper in a fire refining process without additional external heat input.

It is still another object of the present invention to provide a heating and refining process which is relatively free of the formation of tuyere blocking accretions.

SUMMARY OF THE INVENTION

The above and other objects, which will be apparent to those skilled in the art, are achieved by the present invention which comprises in one aspect a process for heating a molten material with a fuel by providing a bath containing molten material at a bath temperature at or above the spontaneous combustion temperature of the fuel, said molten material having at least the same resistance to oxidation by carbon dioxide and water at bath temperature as nickel; injecting oxygen and a fluid fuel into the bath through a tuyere below the surface of the bath, at least a portion of the fluid fuel forming a shroud surrounding the injected oxygen; controlling the amount of the oxygen injected relative to the fluid fuel to no greater than 150% of that required for complete combustion of the fuel; and combusting the fuel to provide heat to the molten material.

In another aspect, the present invention comprises a process for refining impure molten copper having oxygen-containing impurities, including dissolved oxygen, by providing a bath of the impure molten copper; injecting oxygen and a fluid fuel into the bath through a tuyere below the surface of the bath, at least a portion of the fuel forming a shroud surrounding the injected oxygen; controlling the amount of oxygen injected relative to the fuel to less than that required for complete combustion of the fuel; and reacting the injected oxygen, fuel, and oxygen-containing impurities in the bath to reduce and remove the impurities.

In another aspect, the present invention comprises a process for refining impure molten copper having oxidizable impurities, including sulfur, and oxygen-containing impurities, including dissolved oxygen, by providing a bath of the impure molten copper; injecting oxygen and a fuel into the bath through a tuyere below the surface of the bath, at least a portion of the fuel forming a shroud surrounding the injected oxygen; controlling the amount of oxygen injected relative to the fuel to no less than that required for complete combustion of the fuel; reacting the injected oxygen, fuel, and oxidizable impurities in the bath to remove the oxidizable impurities; adjusting the amount of the oxygen injected relative to the fuel to less than that required for complete combustion of the fuel; and reacting the injected oxygen, fuel and oxygen-containing impurities in the bath to reduce and remove the oxygen-containing impurities.

Additional solid material may be added to the molten bath at any point during the heating or refining process and melted primarily by the heat generated by the combustion of the injected fuel and without any additional external heat input.

In one embodiment of the invention all of the fuel forms a shroud surrounding the injected oxygen. In a preferred embodiment, only a portion of the fuel forms a shroud surrounding the injected oxygen and the remaining portion of the fuel. In a more preferred embodiment, a portion of the fuel forms a shroud surrounding the injected oxygen, and the injected oxygen forms a shroud surrounding the remaining portion of the fuel.

DETAILED DESCRIPTION OF THE INVENTION

Figure 1:
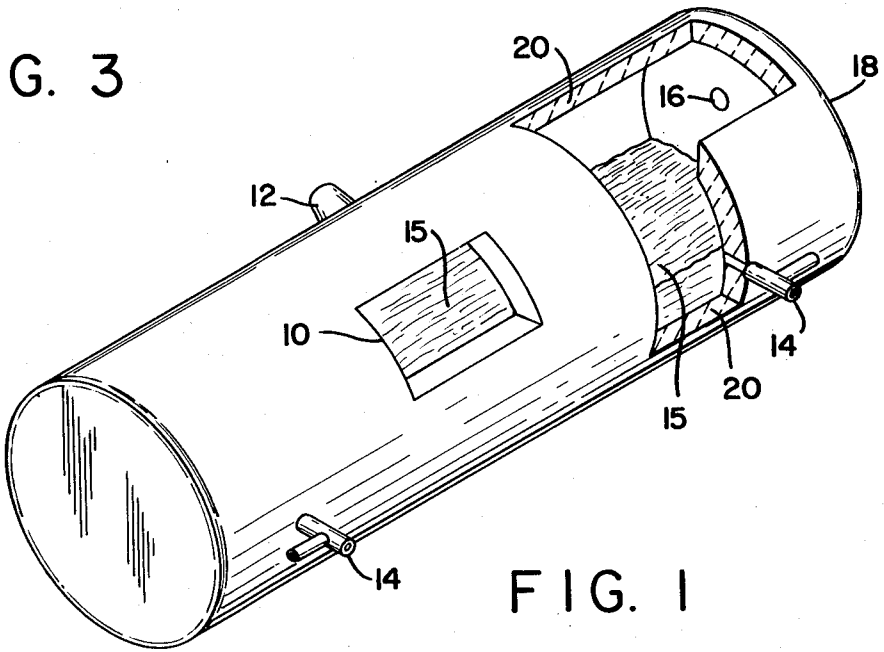
FIG. 1 is an illustration of an anode refining furnace which may be employed in the practice of the invention.

The present invention may be practiced in any suitable vessel for containing and treating molten materials, although a conventional copper anode refining furnace will be used for illustration. Such an anode furnace is shown in a partially cut-away view in FIG. 1. The vessel has the general shape of a horizontal cylinder and is rotatable about its longitudinal axis. The anode furnace has a mouth 10 for charging material and a tap hole 12 through which processed material can be removed. One or more tuyeres 14 are located in the wall of the vessel for subsurface injection of fluids into the molten bath 15 during heating and/or refining. Conventional anode furnaces also have a burner 16, usually mounted in an end wall 18, for injecting combustants above the surface of the molten bath to add additional heat. As will be seen herein, the use of such a burner for additional external heat input is unnecessary in practicing the present invention. The anode furnace is lined with conventional refractory material 20. The present invention is especially suitable for practice in large scale commercial installations and therefore the furnace capacity may be 1 to 150 tons or higher.

The tuyere used in the practice of the present invention is the "shroud" type, the concept of which is well known in the steelmaking art, for example, in the aforementioned Q-BOP process The tuyere may have two or more substantially concentric tubes for separately conveying fluids to the vessel. A protective fluid passes through the substantially annular outermost passageway, thereby forming a shroud around the remaining fluid or fluids which are injected through one or more passageways within the outermost annular passageway. While two tuyeres are shown in FIG. 1, it is contemplated that fewer or more tuyeres may be employed, depending on the proper reaction of injected fluids with the molten material in commercial size batches.

The fluids to be injected in the practice of the present invention are oxygen and a fuel. As used herein, "fuel" refers to a hydrogen-containing substance which reacts exothermically with oxygen, for example, hydrogen or a hydrocarbon. The oxygen is preferably commercial oxygen, i.e., oxygen with a purity of at least 70%, more preferably at least 90% or more. The fluid fuel is a gas, a liquid, or a powdered solid in a non-reactive gaseous or liquid media. When powdered solids are employed, the particle size should be sufficiently fine to avoid blockage in the feed lines and tuyeres. Examples of gaseous hydrocarbon fuels which may be employed are gaseous alkane hydrocarbons, natural gas (which is primarily methane plus other lower alkane hydrocarbons) and methane, ethane, propane, and butane, either individually or in mixture. Examples of liquid fuels which may be employed are fuel oil and kerosene. Examples of powdered fuels are coal, charcoal and sawdust. The preferred fuel used in the present invention is natural gas, unless contamination by uncombusted hydrocarbons or carbon-containing reaction products is a problem, in which case hydrogen is preferred.

The molten bath temperature is such that injection of oxygen and a fluid fuel below the bath surface results in a spontaneous combustion reaction. As used herein, "combustion" refers to the chemical combination of oxygen and a hydrogen-containing fuel resulting in the formation of water ($H_2O$) and/or carbon dioxide ($CO_2$), and accompanied by the release of heat. In practice, stoichiometric amounts of oxygen and a hydrogen-containing fuel will often produce other reaction products as well, for example, carbon monoxide (CO) and hydrogen.

A primary requirement for the molten materials for which the present invention is intended is that they be in the liquid state at temperature at or above the spontaneous combustion temperature of the particular fuel injected. As used herein, the term "spontaneous combustion temperature" refers to the lowest temperature at. which fuel and a source of oxygen will combust without an external source of energy. For example, the spontaneous combustion temperature of natural gas is approximately 1400° F. (760° C.). The material must further be at least as resistant to oxidation by carbon dioxide and water at molten bath temperature as nickel. Suitable metals include copper, nickel, lead, palladium, osmium, gold and silver. Suitable non-metallic materials include alumina, silica, and slags containing silicates, metallic oxides, and lime. Examples of materials which would be unsuitable because of their reactivity include ferrous metal, tin, and chloride salts.

The oxygen and fuel are injected into the aforementioned molten material through a tuyere below the surface of the bath. At least a portion of the fuel is injected through the outermost annular passageway of the tuyere to form a shroud surrounding the oxygen and any remaining portion of fuel. It will be understood by those skilled in the art that due to the mixing, dispersion and reaction of the oxygen and fuel in the molten material, the "shroud" exists only in the immediate vicinity of the tuyere. The fuel shroud performs much the same function as it does in the prior art metal refining processes, e.g., Q-BOP steelmaking, in preventing excessive tuyere wear in the region of the oxygen flow. However, applicants have found that, surprisingly, the fuel shroud may be maintained at relatively high flow rates, compared to the oxygen, without blockage of the tuyeres due to frozen accretions. Further, applicants have found that with the present invention, unexpected advantages in deoxidation efficiency and heat recovery result.

Figure 2:
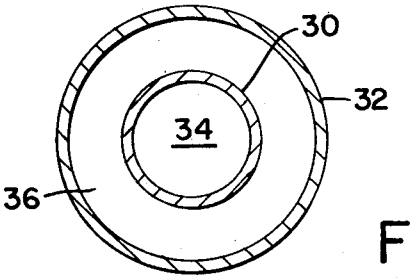
FIG. 2 is an illustration of a single shroud tuyere which may be employed in one embodiment of the invention.

In one embodiment, all of the fuel injected through a tuyere forms a shroud around the oxygen. A single shroud tuyere comprising two concentric tubes may be employed for this embodiment. A suitable single shroud tuyere is illustrated in FIG. 2. In this figure a central tube 30 is shown within an outer tube 32, thereby forming a central passage 34 for oxygen and a surrounding annular passageway 36 for a fuel.

Figure 3:
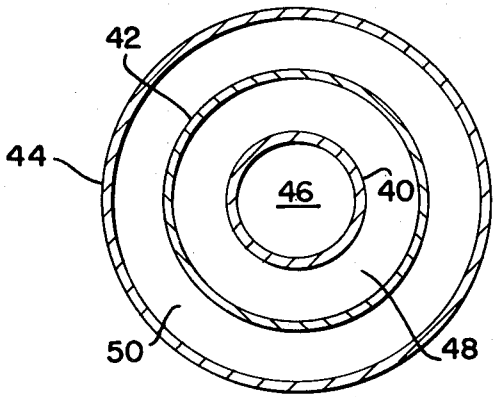
FIG. 3 is an illustration of a double shroud tuyere which may be employed in a preferred embodiment of the invention.

In a preferred embodiment, only a portion of the fuel injected through a tuyere forms a shroud around the oxygen and the remaining fuel. While it is possible to mix the oxygen and remaining fuel and inject the mixture through a central passageway of the tuyere, such premixing is not desirable because of the possibility of fire or explosion in the piping. It is most desirable to inject the oxygen and remaining fuel through separate passageways within the outermost annular passageway. It is preferred that the oxygen itself form a shroud around the remaining fuel. A double shroud tuyere comprising three concentric tubes may be employed for this embodiment as shown in FIG. 3. A central tube 40 is shown with a first outer tube 42, which in turn is within a second outer tube 44. The fuel is injected through the central passageway 46 and the outer annular passageway 50 and the oxygen is injected through the inner annular passageway 48.

In the preferred embodiment, it is desirable to have from about 10 to about 50 percent of the fuel pass through the outermost annular passageway. Where a double shroud tuyere is used, the remaining about 50 to about 90 percent of the fuel passes through the central passageway.

The process of the present invention may be employed for the purpose of providing heat to the aforementioned molten materials. A high rate of heat transfer is provided by submerged combustion of the oxygen and fuel in the bath, which is at temperature above the spontaneous combustion temperature of the fuel. Where most efficient use of injectants is desired, the amount of oxygen injected relative to the fuel should be at or near the exact amount required for complete combustion of the fuel. Satisfactory results may be had by using a wide range of oxygen/fuel ratios, however. Preferably the upper limit of relative oxygen injection is about 150% of that required for complete combustion of the fuel, more preferably 130%. Preferably the lower limit of relative oxygen injection is about 75% of that required for complete combustion of the fuel, more preferably 85%.

The process of the present invention may also be employed to oxidize and remove oxidizable impurities (mainly sulfur but also including zinc, tin and iron) and to reduce and remove oxygen-containing impurities (mainly dissolved oxygen) from molten copper, especially crude or blister copper. The molten copper bath may contain other metals as alloying agents. While oxidation and reduction will normally be performed sequentially, they may be performed separately and independently according to the present invention. Further, the concurrent heat liberation of the process enables solid copper to be added and melted in the molten copper within the normal bath temperature range of about 2000° F. (1090° C.) to about 2200° F. (1200° C.) without the need for additional external heat input to the molten copper.

Oxidation of copper impurities is carried out by injecting oxygen and a fuel in relative amounts whereby no less oxygen is injected than is theoretically required for complete combustion with the fuel. Preferably the amount of oxygen injected is no more than about 450%, more preferably no more than about 300%, of that required for complete combustion with the fuel. Removal of oxidizable impurities is most readily effected by injecting more oxygen than is necessary for complete combustion with the fuel. Impurity removal then occurs mainly by oxidation with the excess injected oxygen and flotation of the impurities up and out of the bath. Even where the amount of oxygen injected is only approximately equal to that necessary for complete combustion with the fuel, and there is little or no excess injected oxygen, non-reactive combustion products such as carbon dioxide and water vapor can purge the bath of impurities. Bubbles of these gases are thought to provide nucleation sites for the oxidation of impurities, including sulfur, by dissolved oxygen. The relative flow rates of the oxygen and fuel are maintained at the above levels until a desired amount of sulfur and other oxidizable impurities is removed from the molten copper. Sulfur levels as low as 0.005% or less have been attained by the process of the present invention.

Reduction of oxygen impurities in molten copper is carried out by injecting oxygen and a fuel in relative amounts whereby less oxygen is injected than is theoretically required for complete combustion with the fuel. Preferably the amount of oxygen injected is no less than about 25%, more preferable no less than about 33%, of that required for complete combustion with the fuel. The injected oxygen and fuel react to partially oxidize the fuel constituents. Primary products of this reaction are hydrogen and, when hydrocarbon fuels are used, carbon monoxide gas. Other products are minor amounts of water vapor and, when hydrocarbon fuels are used, carbon dioxide gas. The primary reaction products are then available to react with dissolved oxygen and other oxygen containing impurities. The relative flow rates of the oxygen and fuel are maintained at the above levels until a desired amount of dissolved oxygen and other oxygen-containing impurities is removed from the molten copper. Oxygen levels as low as 0.05% or less have been attained by the present invention.

Taking the preferred embodiment of the copper oxidation and reduction reactions together, the total range of oxygen injection is from about 25% to about 450% of the amount required for complete combustion with the fuel. When methane is employed as the fuel, the stoichiometric ratio of injected oxygen gas to methane for complete combustion at the reaction temperature of 2100° F. (1150° C.) is 2:1. This translates to a total oxygen volumetric flow range of from about 50% to about 900% of the volumetric flow of methane. Stated in another way, the total volumetric flow range of methane is from about 11% to about 200% of the volumetric flow rate of the oxygen.

Where all or most of the fuel is injected so as to form a shroud around the oxygen, the volumetric flow rate of fuel can be 200% or more of the volumetric flow rate of the oxygen during the reduction reaction. This relative amount of shrouding fuel is well above that employed in other metal refining processes. Despite the great cooling effect of the fuel due to fluid flow (and also endothermic decomposition in the case of hydrocarbon fuels), it has been surprisingly found that frozen accretions do not cause problems during refining of commercial size batches of molten copper. While some copper does solidify in the vicinity of the tuyere, the degree of blockage has been minor as indicated by the approximately 30% increase in fluid pressure needed to inject the fuel below the bath surface, as compared to injection into an empty refining vessel.

The adding and melting of solid material in the molten bath can be performed at any time during the injection of oxygen and fuel into the bath due to the heat generated by combustion of the fuel. Where copper is the molten material, the adding and melting of solid copper may be performed simultaneously with heating or removal of sulfur or oxygen, and the adding and melting may be performed within the conventional copper fire refining temperature range of about 2000° F. to 2200° F. (1090° C. to 1200° C). The present invention makes possible the addition of solid copper in the amount of at least 5–10%, and up to 50% or more of the total refined mass of molten copper. Solid copper additions in the testing of the present invention were limited to about 50% only by the geometrical limitations of the furnace used.

High deoxidation efficiency during copper reduction was attained in practicing the present invention. Efficiencies were at least 60% and ranged up to 71%. These figures were determined on the basis of the use of methane as the fuel. At the nominal reaction temperature of about 2100° F. (1150° C.), deoxidation proceeds according to the equation:

$$CH_4+40 \rightarrow CO_2+2H_2O$$

resulting in a theoretical consumption of 0.165 lb. of oxygen per ft.$^3$ of methane (0.002kg/m3). Comparable deoxidation efficiencies are expected with other fuels. These deoxidation efficiency values were found in commercial size batches of at least 160 tons.

Heat recovery also was very high with the present invention. Heat recovery values were based on refining blister copper in a 13 ft. (3.96m) diameter by 30 ft. (7.6m) length anode furnace of the type illustrated in FIG. 1. At the refining temperature of about 2100° F. (1150° C.), the steady state heat loss to the environment was calculated to be about 70,000 Btu/min (17640kcal/-min). Where all of the fuel forms a shroud surrounding the oxygen, heat recoveries of over 70% were noted in actual commercial operations. Where a portion of the fuel forms a shroud around the oxygen and the remaining fuel, heat recoveries of over 90% were noted, again in commercial operation. While the exact reason for this is not known, it is hypothesized that the greater heat recovery is due to the more complete mixing and combustion of the oxygen and fuel in the preferred embodiment.

Significant improvement in the opacity of off gas emission during copper reduction has been achieved as a result of the present invention. Off-gas opacity of less than 20% is regularly obtainable during reduction of the molten copper when the amount of oxygen injected is from about 25% to about 33% of that required for complete combustion with the fuel. Under these conditions it is not necessary to perform any further treatment of the off-gas as it is emitted from the bath. When the amount of oxygen injected is above this range, but still less than that required for complete combustion with the fuel, a baghouse or equivalent is required to bring opacity below 20%. The low opacity values are a further indication of the high efficiency of the present invention and represent an unexpected improvement over the prior art.

The following non-limiting examples are set forth below for purposes of illustration. The examples are representative of over 50 heats refined in a 13 ft. by 30 ft. (3.96m by 7.6m) cylindrical anode furnace with a nominal capacity of 250 short tons (227 metric tons) of blister copper, similar to that shown in FIG. 1. Two shroud-type tuyeres were positioned approximately 2.5 ft. (0.76 m) from the end walls and 2.5 to 3 ft. (0.76 to 0.91 m) below the bath surface for the injection of the process gases. The furnace had a burner positioned in one end wall to maintain temperature during casting and idle time; the results used to illustrate the process are from data taken when the end wall burner was not in operation. Gas flow rates are given in volumetric flow rate of normal cubic feet per minute determined at 70° F. and 14.7 psi (normal cubic meters per minute at 21° C. and 1 atm). The oxygen used was of 99% purity.

Examples 1 through 4 illustrate the method of practicing the present invention using double shroud tuyeres, similar to that shown in FIG. 3, with the fluid fuel being injected through the central and the outermost annular passageways, and the oxygen being injected through the inner annular passageway. The given distribution of fuel between the central passageway and the outermost annular passageway remained constant during processing in each example.

EXAMPLE 1

A charge of 225 short tons (204 metric tons) of molten blister copper was introduced into an anode furnace. The initial sulfur and oxygen levels of the charge were 0.022% and 0.1933%, respectively.

Oxygen and natural gas were blown into the bath at a volumetric flow ratio of 2/1. The flow rates were 400 ft$^3$/min (11.3m$^3$/min) of oxygen and 200 ft.$^3$/min (5.7m$^3$/min) of natural gas. A double shroud tuyere was used, with 45% of the natural gas being injected through the outermost annular passageway and the remainder being injected through the central passageway. The oxygen was injected through the inner annular passageway. The blow continued for 37 minutes. During this time, 9.6 short tons (8.7 metric tons) of scrap were incrementally added and melted in the bath; the bath temperature increased from 2042° F. (1116° C.) to between 2055° F. and 2100° F. (1124° C. and 1150° C.). During this initial blow the available heat recovery was 95%. Sulfur and oxygen levels were 0.003% and 0.270%, respectively, after the blow.

The oxygen and natural gas flow was then adjusted to 167 ft.$^3$/min (4.7m$^3$/min) oxygen and 250 ft.$^3$/min (7.1m$^3$/min) natural gas for a volumetric flow ration of 2/3. This second blow continued for 52 minutes. During this time 5.4 short tons (4.9 metric tons) of scrap copper were added and melted; the bath temperature ranged from 2057° F. to 2148° F. (1125° C. to 1176° C.). The available heat recovery during this period was 93%, with a deoxidation efficiency of 60%. Oxygen content was reduced to 0.093%.

At this point, 72 short tons (66 metric tons) of copper were tapped from the furnace and cast into anodes. The sulfur and oxygen levels in the cast anodes were 0.003% and 0.11%, respectively.

The remainder of the molten charge was blown for a third time with a volumetric flow ratio of oxygen to natural gas of 2/1. The flow rates were 400 ft.$^3$/min (11.3m$^3$/min) oxygen and 200 ft.$^3$/min (5.7m$^3$/min) natural gas. The third blow continued for 71 minutes, during which time 17 short tons (15.5 metric tons) of scrap were melted. The bath temperature ranged from 2064° F. to 2145° F. (1129° C. to 1174° C.). Available heat recovery was 96% during this period. The oxygen content of the charge increased to 0.13%.

A fourth blow of 300 ft.$^3$/min (8.5m$^3$/min) oxygen and 200 ft.$^3$/min (5.7m$^3$/mm) natural gas was made for 66 minutes (volumetric flow ratio of oxygen to natural gas of 3/2). A total of 13 short tons (11.8 metric tons) of scrap were melted during this blow. The oxygen content was reduced to 0.068% and the available heat recovery was 94%.

A fifth and final blow of 167 ft.$^3$/min (4.7m$^3$/min) oxygen and 250 ft.$^3$/min (7.1m$^3$/min) natural gas was made for 48 minutes (volumetric flow ratio of oxygen to natural gas of 2/3). During this blow 12 short tons (10.9 metric tons) of scrap were added. Final oxygen content was 0.032%. Available heat recovery was 94%.

EXAMPLE 2

One hundred sixty-one short tons (147 metric tons) of molten blister copper containing 0.265% oxygen and 0.0096% sulfur were charged to an anode furnace. Oxygen and natural gas were injected into the molten bath at a volumetric flow ratio of 2/1, the flowrate being 400ft.$^3$/min (11.3m$^3$/min) of oxygen and 200 ft.$^3$/min (5.7m$^3$/min) of natural gas. Double shroud tuyeres were used for injection, with 35% of the natural gas being injected through the outermost annular passageway of the tuyere, with the remaining 65% being injected through the central passageway.

During 96 minutes of blowing at the above ratio, 16 short tons (14.6 metric tons) of scrap were added and melted in the bath. Bath temperature increased from 1980° F. (1082° C.) to 2090° F. (1143° C.) during this time. The calculated heat recovery for this period was 97%. The oxygen content of the bath was reduced to 0.233% and the sulfur content reduced to 0.0004%.

Oxygen and natural gas were then injected into the bath at a volumetric flow ratio of ⅔, the flowrates being 167 ft.$^3$/min (4.7m$^3$/min) of oxygen and 250 ft.$^3$/min (7.1 m$^3$/min) of natural gas. After 40 minutes of blowing at this ratio, the oxygen content was reduced to 0.071% and the bath temperature increased from 2060° F. (1127° C.) to 2106° F.(1152° C.). During this period the calculated heat recovery was 98% and the deoxidation efficiency was 68%. Also during this period no soot was noted in the off-gas, and the off-gas opacity averaged 15%.

EXAMPLE 3

Two hundred thirty-nine short tons (217 metric tons) of molten blister copper containing 0.342% oxygen and 0.276% sulfur were charged to an anode furnace. Air was injected into the molten bath at a rate of 500 ft.$^3$/min (14.2 m$^3$/min) using the double shroud tuyeres. After 70 minutes of blowing air at the above rate, the sulfur content was reduced to 0.0050% and the oxygen content increased from 0.342% to 0.354%.

Oxygen and natural gas were then injected into the bath at a volumetric flow ratio of 2/3, the flowrates being 167 ft.$^3$/min (4.7m$^3$/min) of oxygen and 250 ft.$^3$/min (7.1m$^3$/min) of natural gas. The double shroud tuyeres were again used, with 41% of the natural gas being injected through the outermost annular passageway. During 81 minutes of blowing at this ratio, 8 short tons (7.3 metric tons) of scrap were added and melted. Oxygen content of the bath was reduced from 0.354% to 0.080% and bath temperature increased from 2127° F. (1164° C.) to 2142° F. (1172° C.) during this time. The calculated heat recovery was 97%, the deoxidation efficiency was 71% and the off gas opacity averaged 15% during this period.

EXAMPLE 4

One hundred ninety-seven short tons (179 metric tons) of molten blister copper containing 0.298% oxygen and 0.0010% sulfur were charged to an anode furnace. Oxygen and natural gas were injected into the bath at a volumetric flow ratio of 2/1, the flowrates being 400 ft$^3$/min (11.3m$^3$/min) of oxygen and 200 ft.$^3$/min (5.7m$^3$/min) of natural gas. Double shroud tuyeres were used, with 45% of the natural gas being injected through the outermost annular passageway.

During 42 minutes of blowing at the above ratio, a total of 12 tons of scrap were added and melted in the bath. Bath temperature increased from 2073° F. (1134° C.) to 2142° F. (1172° C.) during this period, and the calculated heat recovery was 93%.

Oxygen and natural gas were then injected into the bath at a volumetric flow ratio of 1/1, the flowrates being 300 ft.$^3$/min (8.5m$^3$/min) of oxygen and 300 ft.$^3$/min (8.5m$^3$/min) of natural gas. After 43 minutes of blowing at this ratio, a total of 6 short tons (5.5 metric tons) of scrap were melted and the bath temperature increased from 2062° F. (1128° C.) to 2128° F. (1164° C.). The calculated heat recovery during this time was 88%. The oxygen content of the bath was reduced to 0.185%.

Oxygen and natural gas were then injected into the bath at a volumetric flow ratio of ⅔, the flowrates being 167 ft.$^3$/min (4.7m$^3$/min) of oxygen and 250 ft.$^3$/min (7.1 m$^3$/min) of natural gas. After 39 minutes of blowing at this ratio, the temperature of the bath increased from 2070° F. (1132° C.) to 2106° F. (1152° C.) and the oxygen content of the bath was further reduced from 0.185% to 0.064%. During this period the calculated heat recovery was 92%, the deoxidation efficiency was 64% and off-gas opacity averaged 15%.

Examples 5 and 6 illustrate the method of practicing the present invention using single shroud tuyeres, similar to that shown in FIG. 2, with the fluid fuel being injected through the outer annular passageway and oxygen being injected through the central passageway.

EXAMPLE 5

One hundred eighty-nine short tons (172 metric tons) of molten blister copper containing 0.360% oxygen and 0.0207% sulfur were charged to an anode furnace. Oxygen and natural gas were injected into the bath at a volumetric flow ratio of 4/3, the flowrates being 400 ft.$^3$/min (11.3m$^3$/min) of oxygen and 300 ft$^3$/min (8.5m$^3$/min) of natural gas.

During 74 minutes of blowing at this ratio, 5.3 short tons (4.8 metric tons) of scrap were added and melted in the bath. Bath temperature increased from 2079° F. (1137° C.) to 2138° F. (1170° C.). The calculated heat recovery during this time 69%. The oxygen content of the copper was reduced to 0.316% and the sulfur content was reduced to 0.0075%

Oxygen and natural gas were then injected into the bath at a volumetric flow ratio of ⅔, the flowrates being 200 ft.$^3$/min (5.7m$^3$/min) of oxygen and 300 ft.$^3$/min (8.5m$^3$/min) of natural gas. After 61 minutes of blowing at this ratio, the bath temperature increased from 2094° F. (1146° C.) to 2137° F. (1170° C.). The calculated heat recovery during this time was 71%. During this time the oxygen content of the bath was further reduced to 0.031%. The deoxidation efficiency was 62%

EXAMPLE 6

Two hundred twenty-two short tons (202 metric tons) of molten blister copper containing 0.319% oxygen and 0.0146% sulfur were charged to an anode furnace. Oxygen and natural gas were injected into the molten bath using single shroud tuyeres. The flowrates of oxygen and natural gas were 400 ft.$^3$/min (11.3 m$^3$/min) of oxygen and 300 ft.$^3$/min (8.5m$^3$/min) of natural gas. During 98 minutes of blowing at this rate, 6 short tons (5.5 metric tons) of scrap were added and melted. The temperature of the bath increased from 2067° F. (1131° C.) to 2135° F. (1168° C.) and the oxygen content was reduced to 0.274% The calculated heat recovery during this time was 73%.

Oxygen and natural gas were then injected into the molten bath at a volumetric flow ratio of ⅔ for 53 minutes, the flowrates being 200 ft.$^3$/min (5.7m$^3$/min) of oxygen and 300 ft.$^3$/min (8.5m$^3$/min) of natural gas. Over this period the bath temperature increased from 2120° F. (1160° C.) to 2150° F. (1177° C.), and the calculated heat recovery was 71%. During this time the oxygen content of the bath was further reduced to 0.064%. The deoxidation efficiency was 70%.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A process for heating a molten material by oxygen and a fluid fuel comprising the steps of:

(a) providing a bath containing molten material at a bath temperature at or above the spontaneous combustion temperature of said fuel, said molten material having at least the same resistance to oxidation by carbon dioxide and water at bath temperature as nickel;

(b) injecting oxygen and said fuel into said bath through a tuyere below the surface of said bath, at least a portion of said fuel forming a shroud surrounding the injected oxygen;

(c) controlling the amount of said oxygen injected relative to said fuel to no greater than about 150% of that required for complete combustion of said fuel; and (d) combusting said fuel to provide heat to said molten material.

2. The process of claim 1 wherein all of said fluid fuel forms a shroud surrounding the injected oxygen.

3. The process of claim 1 wherein a portion of said fluid fuel forms a shroud surrounding both the injected oxygen and the remaining portion of said fuel.

4. The process of claim 3 wherein the shroud-forming fluid fuel is from about 10% to about 50% of the total fuel injected through said tuyere.

5. The process of claim 3 wherein the injected oxygen forms a shroud surrounding the remaining portion of said fuel.

6. The process of claim 1 wherein said material is a metal is selected from the group consisting of copper, nickel, lead, palladium, osmium, gold, and silver.

7. The process of claim 1 wherein said material is a non-metallic material selected from the group consisting of silica, alumina, and slags containing silicates, metallic oxides, and lime.

8. The process of claim 6 wherein said metal is copper.

9. The process of claim 8 additionally comprising, during any of steps (b) through (d), the steps of:

(i) adding solid copper to said molten copper;

(ii) melting said solid copper in said bath primarily by the heat generated in step (d); and (iii) maintaining said bath temperature no lower than about 2000° F. (1090° C.) without additional external heat input.

10. The process of claim 9 wherein said scrap copper after melting comprises at least 5% of said molten copper.

11. The process of claim 1 wherein during step (c) the amount of oxygen injected is from about 75% to about 150% of that required for complete combustion with said fuel.

12. The process of claim 1 wherein the injected oxygen is at least 70% pure.

13. The process of claim 1 wherein said fluid fuel is selected from the group consisting of hydrogen, natural gas, methane, ethane, propane, butane and combinations thereof.

14. A process for refining copper comprising the steps of:

(a) providing a bath of impure molten copper having oxygen containing impurities, including dissolved oxygen:

(b) injecting oxygen and a fluid fuel into said bath through a tuyere below the surface of said bath, at least a portion of said fluid fuel forming a shroud surrounding the injected oxygen;

(c) controlling the amount of said oxygen injected relative to said fluid fuel to less than that required for complete combustion of said fuel; and (d) reacting said injected oxygen, fuel and oxygen-containing impurities in said bath to remove said oxygen-containing impurities.

15. The process of claim 14 wherein all of said fluid fuel forms a shroud surrounding the injected oxygen.

16. The process of claim 14 wherein a portion of said fluid fuel forms a shroud surrounding both the injected oxygen and the remaining portion of said fuel.

17. The process of claim 16 wherein the shroud-forming fluid fuel is from about 10% to about 50% of the total fuel injected through said tuyere.

18. The process of claim 16 wherein the injected oxygen forms a shroud surrounding the remaining portion of said fuel.

19. The process of claim 14 additionally comprising, during any of steps (b) through (d), the steps of:

(i) adding solid copper to said molten copper;

(ii) melting said solid copper in said bath primarily by the heat generated in step (d); and (iii) maintaining said bath temperature no lower than about 2000° F. (1090° C.) without additional external heat input.

20. The process of claim 19 wherein said solid copper after melting comprises at least 5% of said molten copper.

21. The process of claim 14 wherein the amount of said oxygen injected is from about 25% to less than 100% of that required for complete combustion with said fluid fuel.

22. The process of claim 14 wherein the amount of said oxygen injected is from about 33% to less than 100% of that required for complete combustion with said fluid fuel.

23. The process of claim 14 wherein the injected oxygen is at least 70% pure.

24. The process of claim 14 wherein said fluid fuel is selected from the group consisting of hydrogen, natural gas, methane, ethane, propane, butane and combinations thereof.

25. The process of claim 14 wherein during step (c) the amount of said oxygen injected is from about 25% to about 33% of that required for complete combustion with said fuel, and during step (d) reaction products form which are emitted from said bath as off-gas, and the opacity of said off-gas is no greater than 20%.

26. The process of claim 14 wherein said impure molten copper is desulfurized crude or blister copper.

27. A process for refining copper comprising the steps of:

(a) providing a bath of impure molten copper having oxidizable impurities, including sulfur, and oxygen-containing impurities, including dissolved oxygen;

(b) injecting oxygen and a fluid fuel into said bath through a tuyere below the surface of said bath, at least a portion of said fluid fuel forming a shroud surrounding the injected oxygen;

(c) controlling the amount of said oxygen injected relative to said fluid fuel to no less than that required for complete combustion of said fuel;

(d) reacting said injected oxygen, fuel and oxidizable impurities in said bath to remove said oxidizable impurities;

(e) adjusting the amount of said oxygen injected relative to said fluid fuel to less than that required for complete combustion of said fuel; and (f) reacting said injected oxygen, fuel and oxygen-containing impurities in said bath to remove said oxygen-containing impurities.

28. The process of claim 27 wherein all of said fluid fuel forms a shroud surrounding the injected oxygen.

29. The process of claim 27 wherein a portion of said fluid fuel forms a shroud surrounding both the injected oxygen and the remaining portion of said fuel.

30. The process of claim 29 wherein the shroud forming fluid fuel is from about 10% to about 50% of the total fuel injected through said tuyere.

31. The process of claim 29 wherein the injected oxygen forms a shroud surrounding the remaining portion of said fluid fuel.

32. The process of claim 27 additionally comprising, during any of steps (b) through (f), the steps of:

(i) adding solid copper to said molten copper;

(ii) melting said solid copper in said bath primarily by the heat generated in steps (d) or (f); and (iii) maintaining said bath temperature no lower than about 2000° F. (1090° C.) without additional external heat input.

33. The process of claim 32 wherein said solid copper after melting comprises at least 5% of said molten copper.

34. The process of claim 27 wherein the amount of said oxygen injected in step (c) is from 100% to about 450% of that required for complete combustion with said fluid fuel.

35. The process of claim 27 wherein the amount of said oxygen injected in step (c) is from 100% to about 300% of that required for complete combustion with said fluid fuel.

36. The process of claim 27 wherein the amount of said oxygen injected in step (e) is from 25% to less than 100% of that required for complete combustion with said fluid fuel.

37. The process of claim 27 wherein the amount of said oxygen injected in step (e) is from 33% to less than 100% of that required for complete combustion with said fluid fuel.

38. The process of claim 27 wherein the injected oxygen is at least 70% pure.

39. The process of claim 27 wherein said fluid fuel is selected from the group consisting of hydrogen, natural gas, methane, ethane, propane, butane, and combinations thereof.

40. The process of claim 27 wherein during step (e) the amount of said oxygen injected is from about 25% to about 33% of that re quired for complete combustion with said fuel, and during step (f) reaction products form which are emitted from said bath as off-gas, and the opacity of said off-gas is no greater than 20%.

41. The process of claim 27 wherein said impure molten copper is crude or blister copper.

42. A process for refining copper comprising the steps of:

(a) providing a bath of impure molten crude or blister copper having oxidizable impurities, including sulfur, and oxygen-containing impurities, including dissolved oxygen;

(b) injecting oxygen and a fluid fuel into said bath through a tuyere below the surface of said bath, at least a portion of said fluid fuel forming a shroud surrounding the injected oxygen;

(c) controlling the amount of said oxygen injected relative to said fluid fuel to no less than that required for complete combustion of said fuel;

(d) reacting said injected oxygen, fuel and oxidizable impurities in said bath to remove said oxidizable impurities;

(e) adjusting the amount of said oxygen injected relative to said fluid fuel to less than that required for complete combustion of said fuel; and (f) reacting said injected oxygen, fuel and oxygen-containing impurities in said bath to remove said oxygen-containing impurities; and (g) during any one or more of steps b) through (f), the steps of:

(i) adding solid copper to said molten copper;

(ii) melting said solid copper in said bath primarily by the heat generated in steps (d) or (f); and (iii) maintaining said bath temperature no lower than about 2000° F. (1090° C. ) without additional external heat input.

43. The process of claim 42 wherein the shroud-forming fluid fuel is from about 10% to about 50% of the total fuel injected through said tuyere.

44. The process of claim 42 wherein the injected oxygen forms a shroud surrounding the remaining portion of said fuel.

45. The process of claim 42 wherein said solid copper a fter melting comprises at least 5% of said molten copper.

46. The process of claim 42 wherein the amount of said oxygen injected in step (c) is from 100% to about 450% of that required for complete combustion with said fluid fuel.

47. The process of claim 42 wherein the amount of said oxygen injected in step (c) is from 100% to about 300% of that required for complete combustion with said fluid fuel.

48. The process of claim 42 wherein the amount of said oxygen injected in step (e) is from 25% to less than 100% of that required for complete combustion with said fluid fuel.

49. The process of claim 42 wherein the amount of said oxygen injected in step (e) is from 33% to less than 100% of that required for complete combustion with said fluid fuel.

50. The process of claim 42 wherein the injected oxygen is at least 90% pure.

51. The process of claim 42 wherein said fluid fuel is selected from the group consisting of hydrogen, natural gas, methane, ethane, propane, butane, and combinations thereof.

52. The process of claim 42 wherein during step (e) the amount of said oxygen injected is from about 25% to about 33% of that required for complete combustion with said fuel, and during step (f) reaction products form which are emitted from said bath as off-gas, and the opacity of said off-gas is no greater than 20%.

53. The process of claim 1 wherein during step (c) the amount of oxygen injected is less than that required for complete combustion with said fuel.

* * * * *

UNITED STATES PATENT AND TRADEMARK OFFICE

CERTIFICATE OF CORRECTION

PATENT NO. : 4,657,586

DATED : April 14, 1987

INVENTOR(S) : I.F. Masterson et al

It is certified that error appears in the above—identified patent and that said Letters Patent is hereby corrected as shown below:

In column 7, line 65 delete "oxygen" and insert therefor --oxygen-containing--.

In column 9, line 3 in the chemical equation delete "40" and insert therefor --40--.

In column 9, line 28 delete "off gas" and insert therefor --off-gas--.

In column 10, line 27 delete "ration" and insert therefor --ratio--.

In column 12, line 35 between "time" and "69%" insert --was--.

In claim 40, line 3 delete "re quired" and insert therefor --required--.

In claim 42, line 19 delete "and".

In claim 45, line 2 delete "a fter" and insert therefor --after--.

Signed and Sealed this

First Day of September, 1987

*Attest:*

*Attesting Officer*

DONALD J. QUIGG

*Commissioner of Patents and Trademarks*